US006854863B2

(12) United States Patent
Wu

(10) Patent No.: US 6,854,863 B2
(45) Date of Patent: Feb. 15, 2005

(54) MULTI-DIRECTIONAL REFLECTION DECORATIVE LIGHTING EQUIPMENT

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 0 days.

(21) Appl. No.: 10/379,104

(22) Filed: Mar. 4, 2003

(65) Prior Publication Data

US 2004/0174708 A1 Sep. 9, 2004

(51) Int. Cl.[7] ..... H01R 33/00
(52) U.S. Cl. ..... 362/292; 362/297; 362/339
(58) Field of Search ..... 362/252, 253, 362/806, 812, 257, 236, 292, 297, 301, 327, 330, 339, 340, 346, 235, 249

(56) References Cited

U.S. PATENT DOCUMENTS 1,684,922 A * 9/1928 Mammen ..... 362/121
2,199,435 A * 5/1940 Knoonz ..... 362/121
3,700,879 A * 10/1972 Franc ..... 362/99
3,749,903 A * 7/1973 Belokin, Jr. ..... 40/431
4,930,053 A * 5/1990 Vaught ..... 362/121
5,394,315 A * 2/1995 Ahroni ..... 362/226
5,816,686 A * 10/1998 Wang et al. ..... 362/226
6,143,381 A * 11/2000 Hawkins ..... 428/7
6,312,142 B1 * 11/2001 Dorsa ..... 362/257
6,344,279 B1 * 2/2002 Shu ..... 428/542.2
2003/0081409 A1 * 5/2003 Adams et al. ..... 362/122

* cited by examiner

*Primary Examiner*—Thomas M. Sember
*Assistant Examiner*—Hargobind S. Sawhney
(74) *Attorney, Agent, or Firm*—McGlew and Tuttle, P.C.

(57) ABSTRACT

A multi-directional decorative lighting equipment is disclosed. The lighting equipment is composed of a lighting unit and a reflector plate. The lighting unit further includes conductors, a lamp holder, and a lighting element, wherein the lighting element is installed and fixed on the lamp holder, and connected to the power source with the conductors. The reflector plate is fixed to the lamp holder and forms a prescribed angle with lamp element so as to perform multi-directional reflection effect. The reflector plate may be finished with various colors, and its figure may be planar or polyhedral, and the surface thereof may be smooth or rugged.

21 Claims, 4 Drawing Sheets

MULTI-DIRECTIONAL REFLECTION DECORATIVE LIGHTING EQUIPMENT

BACKGROUND OF THE INVENTION

1. Field of the Invention

The present invention relates to multi-directional reflection decorative lighting equipment, and more particularly, to a decorative lighting equipment which has an under reflector plate or plates to reflect light emitted from a lighting element in multiple directions so as to realize a marvelous illumination effect.

2. Description of the Prior Art

Due to its star-like twinkling effect, the flashing lamp group is always welcome on festive days, for commercial advertisements, or by other special occasions, which call for an accent lighting. However, in practical application, care must be taken when arranging the lamps to be connected to the electrical circuit in a proper way so as to prevent hazardous overload of the circuit, or even burn up of conductors or the lighting equipment. Besides, it is always important that the corporated ornamental structure, such as the imitation tree, should be appropriately in match with the lighting equipment to build up an intensified joyful atmosphere.

A generally used decorative lighting unit is shown in FIG. 1. It is composed of a base A1, a lamp A2 installed on the base A1, and two conductors A3 connected to a power source. However, the decorative lighting unit constructed as such can only illuminate a limited area because the light emitted from the lamp A2 is directly radiated to the surrounding air so that only limited ornamental effect of this lighting equipment can be expected.

The present invention has been made in order to eliminate lack of variety inherent to the conventional decorative lighting as mentioned above.

SUMMARY OF THE INVENTION

Accordingly, it is an object of the present invention to provide a decorative lighting equipment which is provided with an under reflector plate, or plates to reflect light emitted from a lighting element in multiple directions so as to eliminate lack of variety inherent to the conventional decorative lighting.

To achieve the above object, the decorative lighting equipment of the present invention is composed of a lighting unit, and a reflector plate, or plates, the lighting unit further includes conductors, a lamp holder, and a lighting element, wherein the lighting element is installed on the lamp holder, and connected to the power source with the conductors, and the lamp holder is fastened with a holding means.

The reflector plate is fixed on the holding means of the lamp holder so as to form a prescribed angle with the lamp element such that multi-directional reflection effect can be attained. The lighting element may be a tungsten lamp, or a LED.

BRIEF DESCRIPTION OF THE DRAWINGS

The accompanying drawings, which are included to provide a further understanding of the invention, and incorporated in and constitute a part of this specification, illustrate embodiments of the invention and together with the description serve to explain the principles of the invention, wherein.

DETAILED DESCRIPTION OF THE PREFERRED EMBODIMENT

Figure 1:
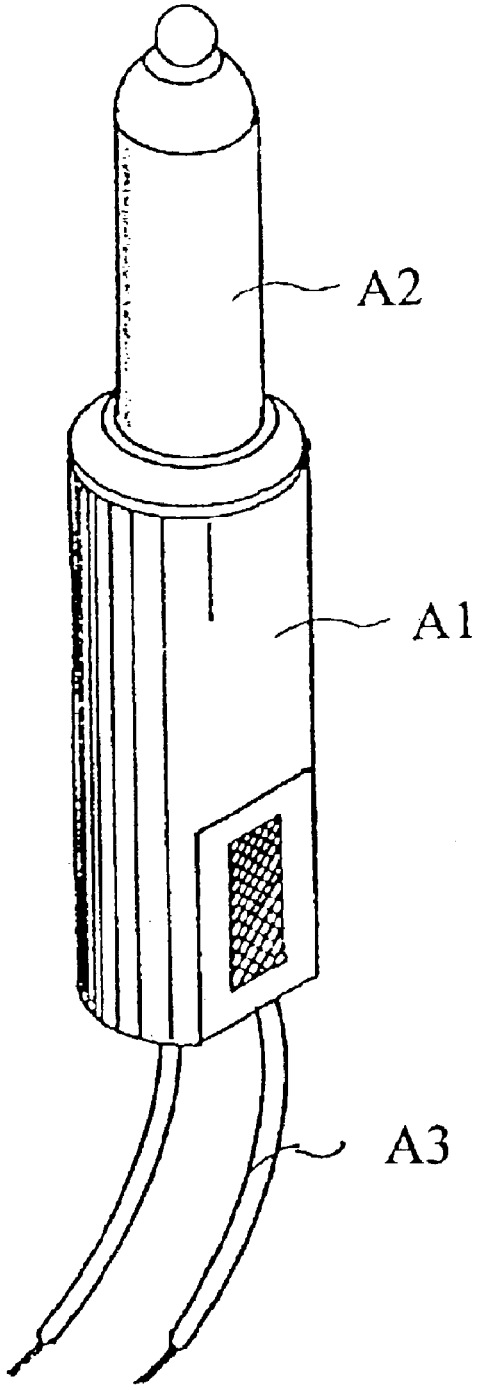
FIG. 1 is a three-dimensional view of a conventional decorative lighting unit.
Figures 2, 3:
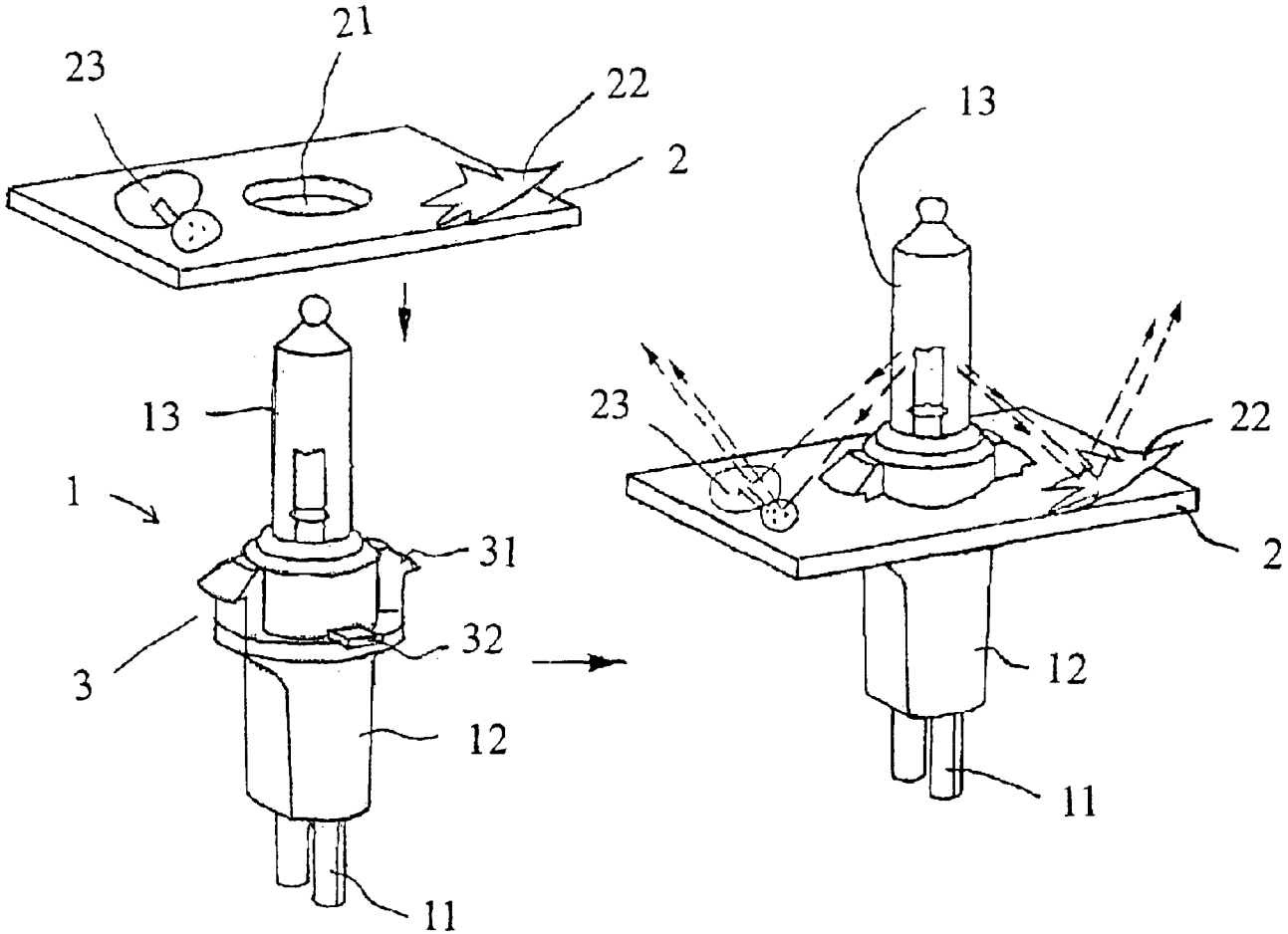
FIG. 2 is a three-dimensional view of the present invention.
FIG. 3 is a three-dimensional exploded view of the present invention.

Referring to FIG. 2, a three-dimensional view of the present invention, in which the decorative lighting equipment is composed of a lighting unit 1 and a reflector plate 2. The lighting unit 1 further includes conductors 11, a lamp holder 12, and a lighting element 13. The lighting element 13 may be a tungsten lamp, or a LED, which is installed on the lamp holder 12, and connected to the power source with the conductors 11, and the lamp holder 12 fastened with a holding means 3 provided on the lamp holder 12. The holding means 3 has two skirt-like flanges 31 formed facing each other at its outer surface thereof, and a supporter 32 is emerged out of the bottom of the holding means 3 along the direction perpendicular to the facing direction of the two flanges 31. The reflector plate 2 is configurated into a long rectangular shape with a via hole 21 formed at its center thereof in order to let through the lighting element 13, and also the reflector plate 2 may be sleeved over the lamp holder 12 and engaged with the holding means 3 by being tightly fixed at its flanges 31. Several reflecting faces 22, 23 may be provided on the plate surface apart a distance from the via hole 21 so as to form multi-directional reflecting zones with those reflecting faces 22, 23 thus diffusing the light of the lighting element in all directions.

In an embodiment of the present invention shown in FIG. 3, after the reflector plate 2 is set and fixed by the flanges 31 of the holding means 3, the light emitted from the lighting element 13 is reflected in multi-directions thereby creating a marvelous illumination effect.

Figure 4:
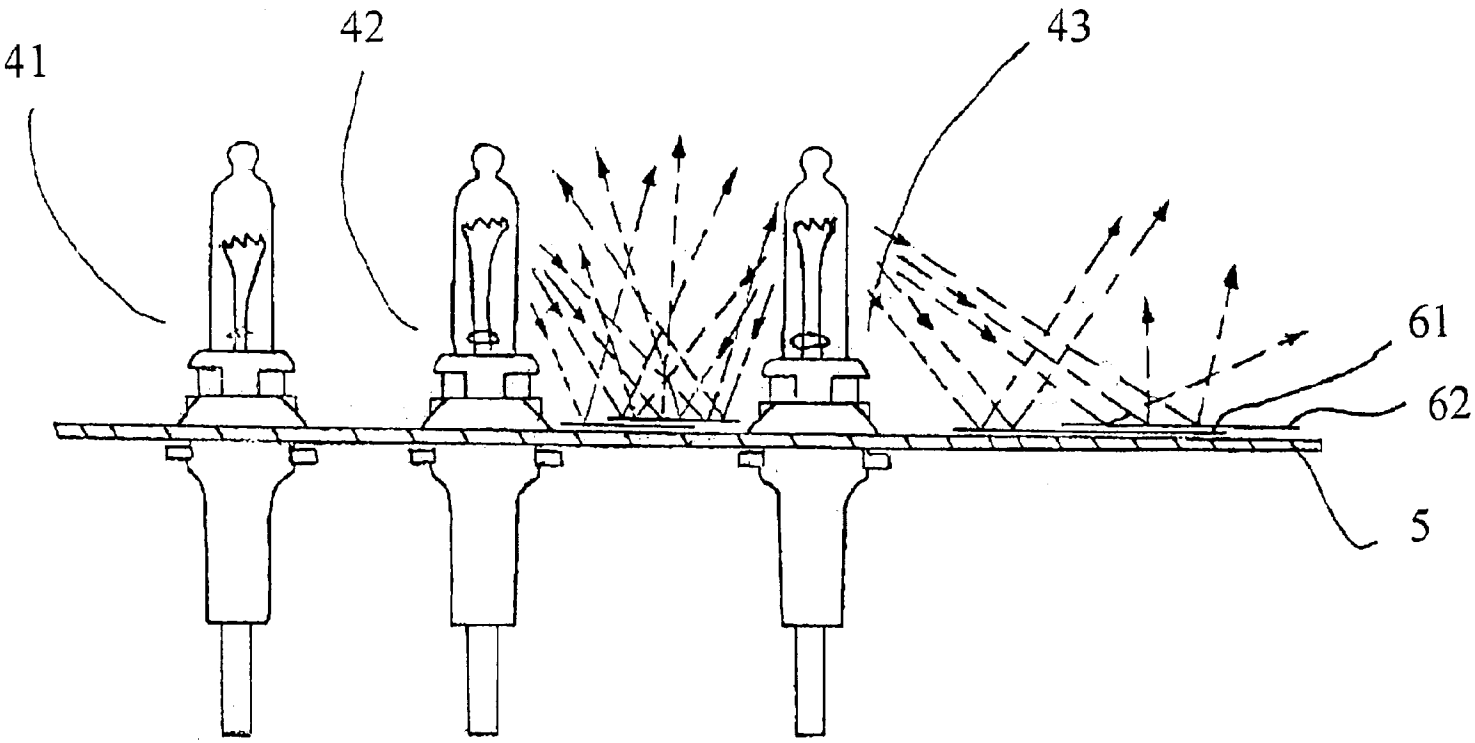
FIG. 4 is another embodiment of the present invention.

In another embodiment shown in FIG. 4, a plurality of lighting units 41, 42, 43 . . . are disposed on a common reflector plate 5, and a multi-layered reflecting face 6 including an upper layer and a lower layer reflecting faces 61, 62 is formed around the lighting units on the common reflector plate 5. A gap is allowable between the upper and the lower layers 61, 62. With this structure, the light emitted from the lighting element is reflected in different directions by the multi-layered reflecting face 6 thereby creating more delicate illumination effect.

Figure 5:
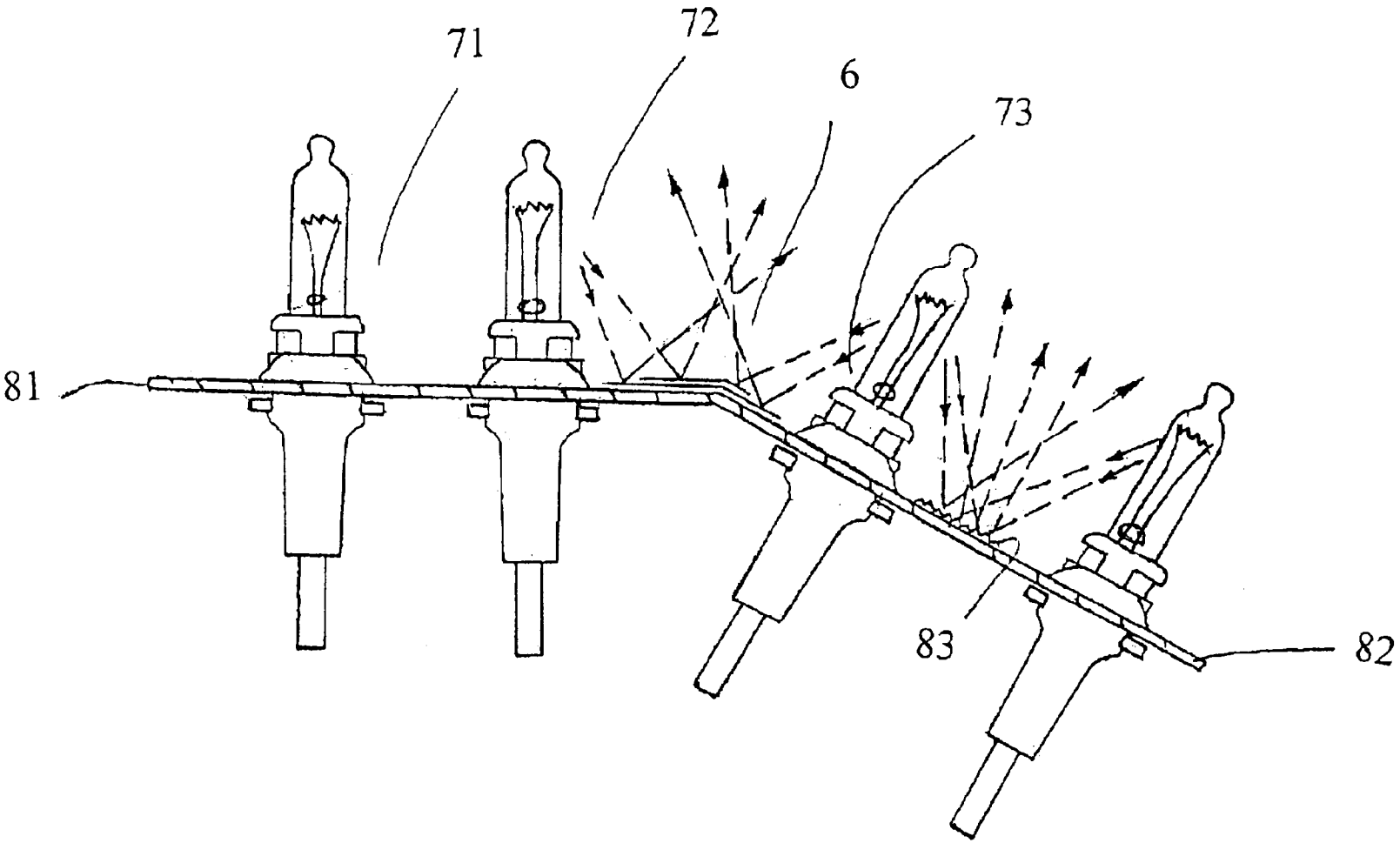
FIG. 5 is one more embodiment of the present invention.

In one more embodiment shown in FIG. 5, a plurality of lighting units 71, 72, 73 . . . are disposed on a horizontal reflector plate 81, and an inclined reflector plate 82 jointed with each other with a predetermined angle. On these two reflector plates 81 and 82, a rugged reflecting face 83 is formed in addition to the above-mentioned multi-layered reflecting face 6. With this structure, reflection of light can be carried out in more sophisticated manner so as to intensify the decorative lighting effect.

The lighting units in this embodiment may be arranged to configurate a desired pattern, characters or predesigned contour, and colored reflector plates are also applicable. The reflecting face of the reflector plate may be finished by printing, coating, sputtering, or adhering. Besides, the reflector plate itself may be a three-dimensional polyhedron.

Other embodiments of the present invention will become obvious to those skilled in the art in light of above disclosure. It is of course also understood that the scope of the present invention is not to be determined by the foregoing description, but only by the following claims.

What is claimed is:

1. A multi-directional reflection lighting equipment comprising:

a lighting element having a longitudinal axis:

a lamp holder connected to said lighting element:

electrical conductors connected to said lighting element and said lamp holder:

a reflector plate connected to said lamp holder, a plurality of reflecting faces arranged on said reflector plate, each of said reflecting faces being arranged on said reflector plate at a different angle with respect to said longitudinal axis of said lighting element;

said reflector plate defining a plurality of holes;

a plurality of said lighting elements with a plurality of said lamp holders being arranged in said boles of said reflector plate.

2. The decorative lighting equipment as in claim 1, wherein said lighting element is one of a tungsten lamp (incandescent limp) and a LED (Light Emission Diode).

3. The decorative lighting equipment as in claim 1, wherein said lighting elements are arranged to configurate a desire pattern, characters or predesigned contour.

4. The decorative lighting equipment as in claim 1, wherein said reflecting faces form several multi-direction reflecting zones.

5. The decorative lighting equipment as in claim 1, wherein said reflector plate reflects the incident light in the same direction from the same reflecting zone.

6. The decorative lighting equipment as in claim 1, wherein said reflector plate reflects the incident light in different directions from the same reflecting zone.

7. The decorative lighting equipment as in claim 1, wherein said reflector plate reflects the incident light in the same direction from different reflecting zones.

8. The decorative lighting equipment as in claim 1, wherein said reflector plate reflects the incident light in different directions from different reflecting zones.

9. The decorative lighting equipment as in claim 1, wherein said reflector plate is a multi-layered reflecting face.

10. The decorative lighting equipment as in claim 1, wherein said reflector plate is a various colored reflector plate.

11. The decorative lighting equipment as in claim 1, wherein said reflecting face of said reflector plate is finished by printing, coating, sputtering, or adhering.

12. The decorative lighting equipment as in claim 1, wherein the surface of said reflector plate is rugged.

13. The decorative lighting equipment as in claim 1, wherein said reflector plate is a polyhedron reflector.

14. The decorative lighting equipment as in claim 1, wherein said multi-layered reflector plate has a clearance between two layers.

15. The equipment in accordance with claim 1, wherein:

each of said plurality of reflecting faces are arranged at a different height with respect to said reflector plate.

16. The equipment in accordance with claim 1, wherein:

said reflector plate is substantially flat and arranged substantially perpendicular to said longitudinal axis;

said reflector plate defines a hole and said lighting element with said lamp holder is arranged in said hole.

17. A multi-directional reflection lighting equipment comprising:

a lighting element having a longitudinal axis;

a lamp holder connected to said lighting element;

electrical conductors connected to said lighting element and said lamp holder;

a reflector plate connected to said lamp holder;

a plurality of reflecting faces arranged on said reflector plate, each of said reflecting faces being arranged on said reflector plate at a different angle with respect to said longitudinal axis of said lighting element;

another reflector plate with an edge connected to an edge of said reflector plate, said another reflector plate defining another hole, said reflecting plate and said another reflecting plate being substantially flat and angularly spaced from each other;

another lighting element connected with another lamp holder and arranged in said another hole of said another reflecting plate.

18. The equipment in accordance with claim 17, wherein:

each of said reflector plates defines a plurality of holes;

a plurality of said lighting elements with a plurality of said lamp holders are arranged in said holes of said reflector plate;

a plurality of said another lighting elements with a plurality of said another lamp holders are arranged in said holes of said another reflector plate.

19. A multi-directional reflection lighting equipment comprising:

a lighting element having a longitudinal axis;

a lamp holder connected to said lighting element;

electrical conductors connected to said lighting element and said lamp holder;

a reflector plate connected to said lamp holder:

a plurality of reflecting faces arranged on said reflector plate, each of said reflecting faces being arranged on said reflector plate at a different angle with respect to said longitudinal axis of said lighting element;

each of said plurality of reflecting faces ate being arranged at a different angle with respect to said reflector plate.

20. A multi-directional reflection lighting equipment comprising:

a lighting element having a longitudinal axis;

a lamp holder connected to said lighting element;

electrical conductors connected to said lighting element and said lamp holder;

a reflector plate connected to said lamp holder;

a plurality of reflecting faces arranged on said reflector plate, each of said reflecting faces being arranged on said reflector plate at a different angle with respect to said longitudinal axis of said lighting element.

a holding mount connects said lamp holder to said reflector plate, said holding mount includes a plurality of skirt shaped flanges on one side of said reflector plate and a supporter on another side of said reflector plate.

21. The equipment in accordance with claim 20, wherein:

said reflector plate defines a plurality of holes;

a plurality of lighting elements with lamp holders are arranged in said holes of said reflector plate:

another reflector plate is connected to said reflector plate and defines another plurality of holes, said reflecting plate and said another reflecting plate being substantially flat and angularly spaced from each other;

another plurality of lighting elements connected with another plurality of lamp holders and arranged in said another plurality of boles of said another reflecting plate;

said lamp holder has a longitudinal axis substantially aligned with said longitudinal axis of said lighting element;

each of said plurality of reflecting faces are arranged at a different angle with respect to said reflector plate;

each of said plurality of reflecting faces are arranged at a different height with respect to said reflector plate;

a holding mount connects said lamp holder to said reflector plate, said holding mount includes a plurality of skirt shaped flanges on one side of said reflector plate and a supporter on another side of said reflector plate.

* * * * *